US009745984B2

(12) United States Patent
Chang

(10) Patent No.: US 9,745,984 B2
(45) Date of Patent: Aug. 29, 2017

(54) FAN AND PRESSURE-INCREASING BLADE ASSEMBLY THEREOF

(71) Applicant: DELTA ELECTRONICS, INC., Taoyuan Hsien (TW)

(72) Inventor: Shun-Chen Chang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 988 days.

(21) Appl. No.: 13/831,314

(22) Filed: Mar. 14, 2013

(65) Prior Publication Data

US 2014/0086730 A1 Mar. 27, 2014

(30) Foreign Application Priority Data

Sep. 27, 2012 (CN) ..... 2012 1 0369990

(51) Int. Cl.

| | |
|---|---|
| ***F04D 29/00*** | (2006.01) |
| ***F04D 19/00*** | (2006.01) |
| ***F04D 29/32*** | (2006.01) |
| ***F04D 29/54*** | (2006.01) |
| ***F04D 25/16*** | (2006.01) |

(52) U.S. Cl.

CPC ..... *F04D 19/002* (2013.01); *F04D 25/166* (2013.01); *F04D 29/326* (2013.01); *F04D 29/327* (2013.01); *F04D 29/329* (2013.01); *F04D 29/542* (2013.01); *F04D 29/544* (2013.01)

(58) Field of Classification Search

CPC .... F04D 19/002; F04D 29/326; F04D 29/327; F04D 29/329; F04D 29/542; F04D 29/544

See application file for complete search history.

(56) References Cited

U.S. PATENT DOCUMENTS 3,291,381 A * 12/1966 Troller ..... F04D 19/002 415/208.2
4,981,416 A * 1/1991 Nevin ..... F24C 15/322 415/206
2003/0194313 A1* 10/2003 Lin ..... F01D 1/02 415/198.1

(Continued)

*Primary Examiner* — Charles Freay
*Assistant Examiner* — Christopher Bobish
(74) *Attorney, Agent, or Firm* — Kirton McConkie; Evan R. Witt

(57) ABSTRACT

A fan includes a frame and an impeller including a hub, a plurality of first blades, a first ring-shaped structure, and a plurality of second blades. The first blades are disposed around the hub. The hub and the first blades are surrounded by the first ring-shaped structure connected with the ends of the first blades, and a central area is structured therebetween. The second blades are connected with an outer rim of the first ring-shaped structure. The frame includes a base, an axle tube portion disposed on the base, and a receiving portion. The impeller is disposed on the axle tube portion. The receiving portion includes plural third blades disposed around the base corresponding to the central area. The first and third blades are matched to each other to be assembled for transforming a tangent velocity into a static pressure to increase the pressure generated by the central area.

16 Claims, 6 Drawing Sheets

(56) References Cited

U.S. PATENT DOCUMENTS

| | | | | |
|---|---|---|---|---|
| 2006/0034688 | A1* | 2/2006 | Kupferberg | F04D 29/164<br>415/211.2 |
| 2007/0031248 | A1* | 2/2007 | Hsu | F04D 29/542<br>415/191 |

* cited by examiner

FAN AND PRESSURE-INCREASING BLADE ASSEMBLY THEREOF

FIELD OF THE INVENTION

The present invention relates to a fan, and more particularly to a fan and a pressure-increasing blade assembly thereof.

BACKGROUND OF THE INVENTION

In the modern society, the science, the technology and the civilization are getting more progressive day by day. Lot types of electronic devices like smart phones, personal computers, desktop PCs, notebook PCs, servers, and air conditioners are highly related with people's daily life. The electronic devices usually generate heats during operating, so that the electronic devices may crash or breakdown when operating under high temperature environment. Under this circumstance, the fans are applied to the electronic devices for heat-dissipation. By enhancing the circulation, the heats generated by the electronic devices are effectively reduced, and the life of the electronic devices is extended and the stability of the electronic devices is enhanced.

Generally, the conventional fans are driven by motors so as to rotate and generate airflows. The output-pressure outputted by the fans is substantially in direct proportion to the radius, i.e. the pressure is increasing from the position representing smaller radius to the position representing larger radius. Therefore, the output-pressure is largest at the outer position of a blade of an impeller and smallest at the central area of the blade of the impeller. The difference of the output-pressures causes an uneven problem during doing work of the blade of the fan. To solve this uneven problem, a bigger or a larger fan is conventionally used to generate airflows with enough output-pressure so as to satisfy the practical demands.

However, the lifestyle and the trend of technology nowadays are significantly changed, and the requirement of the electronic devices is also changed. For designing or manufacturing a product with smaller size and thinner thickness, the factors of limitations of space and location must be considered. It is the reason why the larger fan and the larger motor are not used when considering the higher efficiency or larger area of heat-dissipation. As a result, the uneven problem during doing work still remains. Not only the requirement of higher efficiency and larger area of heat-dissipation cannot be satisfied, but also the expected performance cannot be implemented, which causes the waste of space and energy.

There is a need of providing an improved fan and a pressure-increasing blade assembly thereof to obviate the drawbacks encountered from the prior art.

SUMMARY OF THE INVENTION

The present invention provides a fan and a pressure-increasing blade assembly thereof in order to eliminate the drawbacks caused by the uneven problem during doing work of conventional fans and avoid the waste of space and energy.

The present invention also provides a fan and a pressure-increasing blade assembly thereof. The fan utilizes a receiving portion to transform a velocity of an airflow generated by a central area of the fan into a static pressure so as to equilibrate the output-pressure and the work done by an impeller, in which the fan is used for high-efficiency and large-area heat-dissipation.

The present invention further provides a fan and a pressure-increasing blade assembly thereof. Since the receiving portion is disposed corresponding to the central area of the impeller and the structure of the receiving portion is matched to the central area of the impeller, the waste of space and energy is avoided and the product requirement of smaller size and thinner thickness is satisfied.

In accordance with an aspect of the present invention, there is provided a fan. The fan includes an impeller forming a central area in a specific radius and a frame. The impeller includes a hub, a plurality of first blades, a first ring-shaped structure, and a plurality of second blades. The first blades are disposed around the hub. The hub and the first blades are surrounded by the first ring-shaped structure, and the first ring-shaped structure is connected with the ends of the first blades. The central area is structured between the first ring-shaped structure and the hub. The second blades are connected with an outer rim of the first ring-shaped structure. The frame includes a base, an axle tube portion and a receiving portion. The axle tube portion is disposed on the base, and the impeller is disposed on the axle tube portion. The receiving portion includes a plurality of third blades. The third blades are disposed around the base corresponding to the central area of the impeller. The first blades and the third blades are matched to each other to be assembled as a pressure-increasing blade assembly. A tangent velocity of an airflow generated by the rotation of the central area is transformed into a static pressure by the pressure-increasing blade assembly, such that the pressure generated by the central area is increased.

In accordance with another aspect of the present invention, there is provided a pressure-increasing blade assembly of a fan. The fan includes an impeller forming a central area in a specific radius and a frame. The impeller includes a hub, a plurality of first blades, a first ring-shaped structure, and a plurality of second blades. The first blades are disposed around the hub. The hub and the first blades are surrounded by the first ring-shaped structure, and the first ring-shaped structure is connected with the ends of the first blades. The central area is structured between the first ring-shaped structure and the hub. The second blades are connected with an outer rim of the first ring-shaped structure. The frame includes a base, an axle tube portion and a receiving portion. The axle tube portion is disposed on the base, and the impeller is disposed on the axle tube portion. The receiving portion includes a plurality of third blades. The third blades are disposed around the base corresponding to the central area of the impeller. The first blades and the third blades are matched to each other to be assembled as the pressure-increasing blade assembly. A tangent velocity of an airflow generated by the rotation of the central area is transformed into a static pressure by the pressure-increasing blade assembly, such that the pressure generated by the central area is increased.

In accordance with still another aspect of the present invention, there is provided a pressure-increasing blade assembly of a fan. The fan includes an impeller forming a central area in a specific radius and a frame. The impeller includes a hub, a plurality of first blades, a first ring-shaped structure, and a plurality of second blades. The first blades are disposed around the hub. The hub and the first blades are surrounded by the first ring-shaped structure, and the first ring-shaped structure is connected with the ends of the first blades. The central area is structured between the first ring-shaped structure and the hub. The second blades are connected with an outer rim of the first ring-shaped structure. The air is forced toward the same direction or toward different directions by the first blades and the second blades. The frame includes a base, an axle tube portion and a receiving portion. The axle tube portion is disposed on the base, and the impeller is disposed on the axle tube portion. The receiving portion includes a plurality of third blades. The third blades are disposed around the base and on an airflow path of the central area of the impeller. The first blades and the third blades are matched to each other to be assembled as the pressure-increasing blade assembly. The third blades have the similar shape and exterior as the first blades. A rotating direction of the first blades is in a reverse direction opposite to the rotating direction of the third blades. The air is forced toward the same direction by the first blades and the third blades. A head end of either of the first blades is aligned with a tail end of either of the third blades in an instant of rotation of the impeller, so that a tangent velocity of an airflow generated by the first blades is transformed into a static pressure, and the pressure generated by the central area of the impeller is increased.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
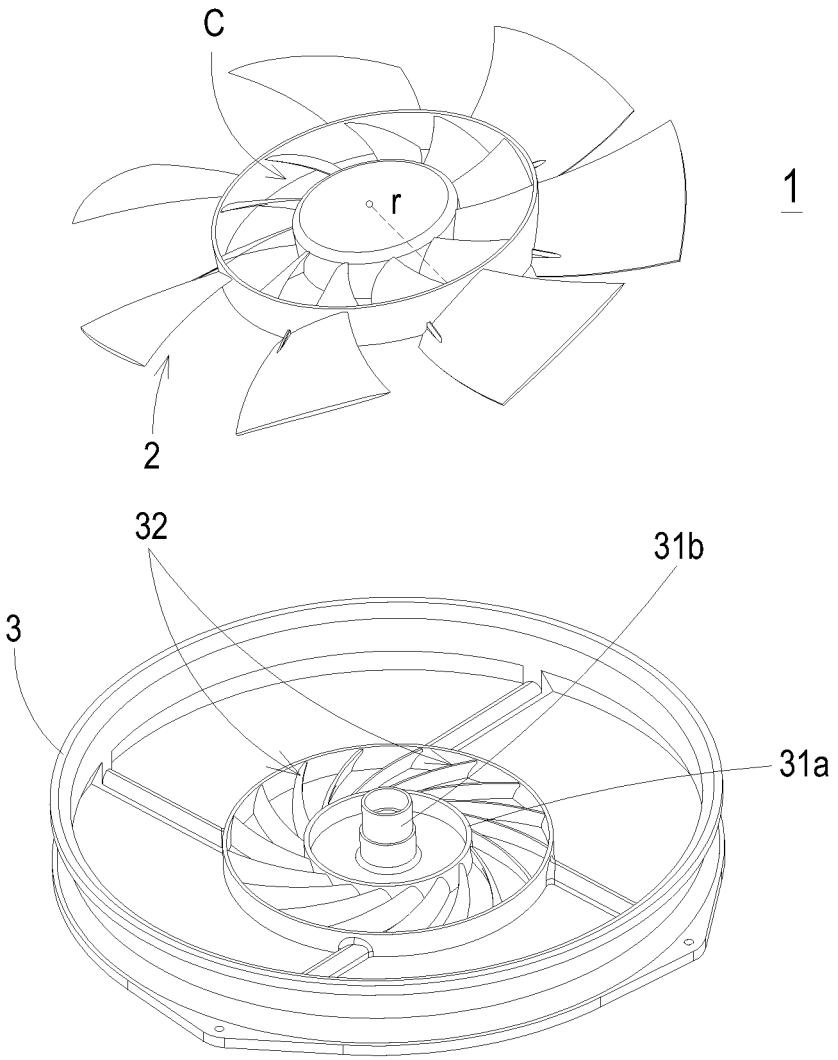
FIG. 1 schematically illustrates an exploded view of a fan according to an embodiment of the present invention.
Figure 2A:
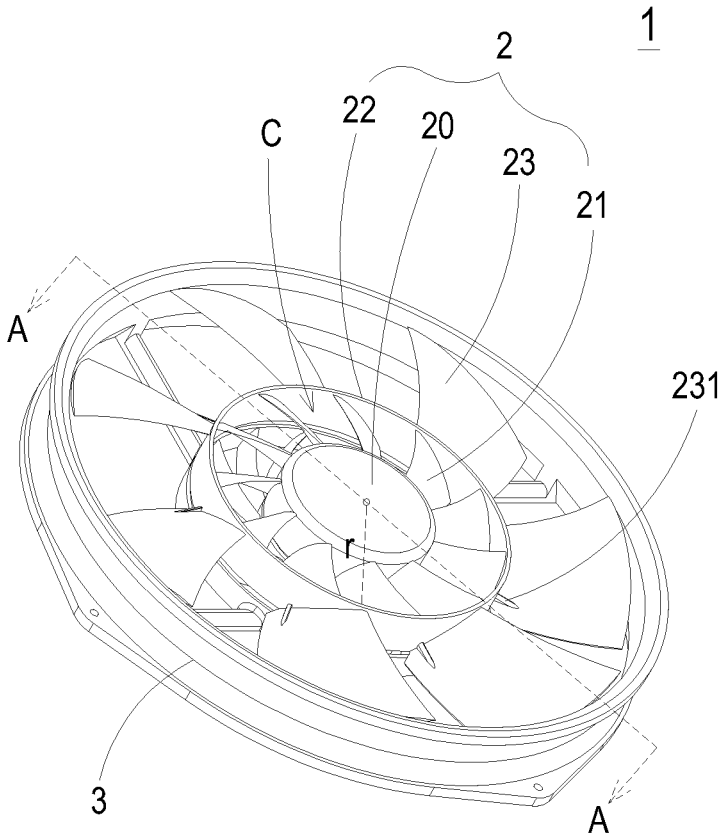
FIG. 2A schematically illustrates a front view of the configuration of the fan as shown in FIG. 1.
Figure 2B:
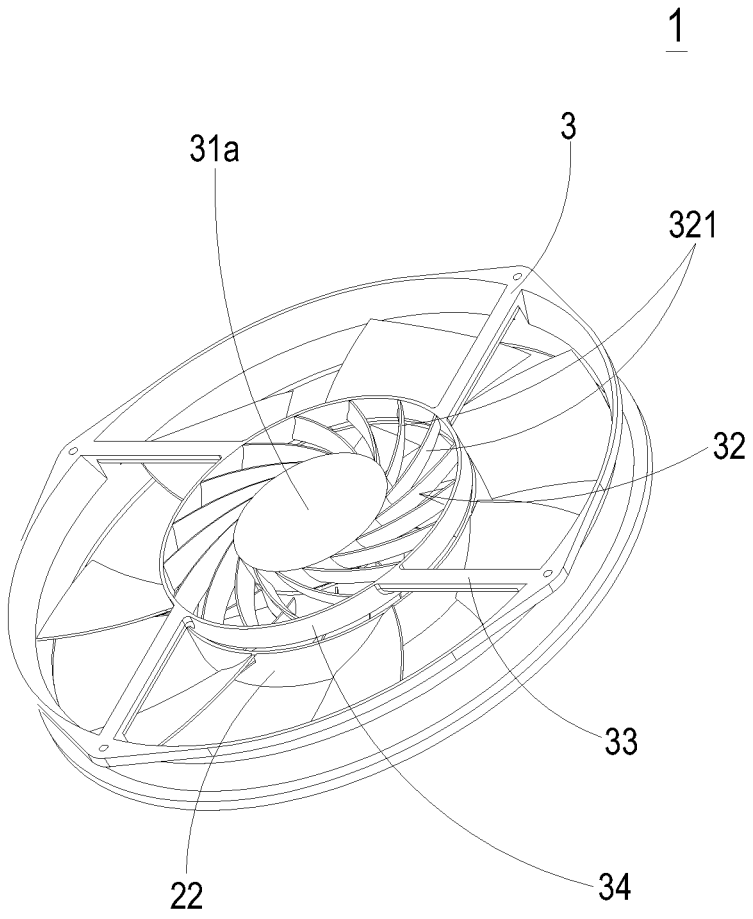
FIG. 2B schematically illustrates a rear view of the configuration of the fan as shown in FIG. 1.

Please refer to FIGS. 1, 2A and 2B. FIG. 1 schematically illustrates an exploded view of a fan according to an embodiment of the present invention. FIG. 2A schematically illustrates a front view of the configuration of the fan as shown in FIG. 1. FIG. 2B schematically illustrates a rear view of the configuration of the fan as shown in FIG. 1. The fan 1 of the present invention is used for facilitating circulation and heat-dissipation, guiding the airflows and controlling the temperature of the environment. An example of the fan 1 includes but is not limited to a circulation fan, an exhaust fan or a ventilation fan. The fan 1 includes an impeller 2 and a frame 3.

The impeller 2 is forming a central area C in a specific radius r and including a hub 20, a plurality of first blades 21, a first ring-shaped structure 22, and a plurality of second blades 23. The plural first blades 21 are disposed around the hub 20. The first ring-shaped structure 22 is connected with ends of the plural first blades 21. The hub 20 and the plural first blades 21 are surrounded by the first ring-shaped structure 22 in the specific radius r, and the central area C is structured between the first ring-shaped structure 22 and the hub 20. The plural second blades 23 are equidistantly connected with an outer rim of the first ring-shaped structure 22, respectively. Additionally, the second blades 23 are not limited to be the extending parts of the first blades 21 or blades having structure and exterior distinct from the first blades 21.

The frame 3 includes a base 31*a*, an axle tube portion 31*b*, and a receiving portion 32. The axle tube portion 31*b* is disposed on the base 31*a*. The impeller 2 is disposed on the axle tube portion 31*b* so as to rotate on the axle tube portion 31*b*. The receiving portion 32 includes a plurality of third blades 321. The plural third blades 321 are disposed around the base 31*a* and disposed between the frame 3 and the axle tube portion 31*b* corresponding to the central area C of the impeller 2.

The receiving portion 32 is coupled to the first blades 21, in which the first blades 21 and the third blades 321 are matched to each other to be assembled as a pressure-increasing blade assembly. For example, the third blades 321 may be shape-coupled or exterior-coupled to the first blades 21 (i.e. the third blades 321 have the similar shape and exterior as the first blades 21), but not limited thereto. A tangent velocity of an airflow generated by rotation of the central area C of the impeller 2 is transformed into a static pressure by the pressure-increasing blade assembly, such that the pressure generated and outputted by the central area C is increased. Furthermore, the pressure outputted and the work done by the impeller 2 are equilibrated, hence the fan 1 is utilized for high-efficiency heat-dissipation, the waste of space and energy is avoided, and the product requirement of smaller size and thinner thickness is satisfied.

In some embodiments, the first blades 21 rotate in a reverse direction opposite to the rotating direction of the third blades 321 and force air toward the same direction as the third blades 321. On the other hand, the first blades 21 and the second blades 23 force air toward the same direction or toward different directions.

Please refer to FIGS. 2A and 2B again. The frame 3 of the fan 1 of the present invention may be used for accommodating the components of the fan 1 and supporting the impeller 2 and the receiving portion 32. The frame 3 further includes a plurality of ribbings 33 for strengthening the structural strength of the frame 3, improving the safety of the fan 1 during operating, and further complying the safety regulations.

Moreover, at least one of the second blades 23 of the impeller 2 of the present invention 2 further has a strengthening rib 231 disposed on the second blade 23 and connected with the first ring-shaped structure 22 for strengthening the connection between the second blade 23 and the first ring-shaped structure 22. In addition, when the second blade 23 having the strengthening rib 231 is connected with the outer rim of the first ring-shaped structure 22 and at least partially exposed outside the first ring-shaped structure 22, the strengthening rib 231 is used for facilitating the fixing of the second blade 23, such that the turbulence caused by vibrating of the exposed edge of the second blade 23 is reduced and the possibility of fracture of the second blade 23 is eliminated.

In some embodiments, the frame 3 of the fan 1 of the present invention further includes a second ring-shaped structure 34 disposed opposite the first ring-shaped structure 22 of the impeller 2 and connected with the ribbings 33, so that the receiving portion 32 is disposed between the base 31*a* and the second ring-shaped structure 34 corresponding to the central area C of the impeller 2. In another embodiment, an end of each of the third blades 321 is connected with the base 31*a*, and the other end of each of the third blades 321 is connected with the second ring-shaped structure 34 of the frame 3, among which the connection between the third blades 321, the base 31*a* and the second ring-shaped structure 34 is not limited to a equidistant connection.

Figure 3:
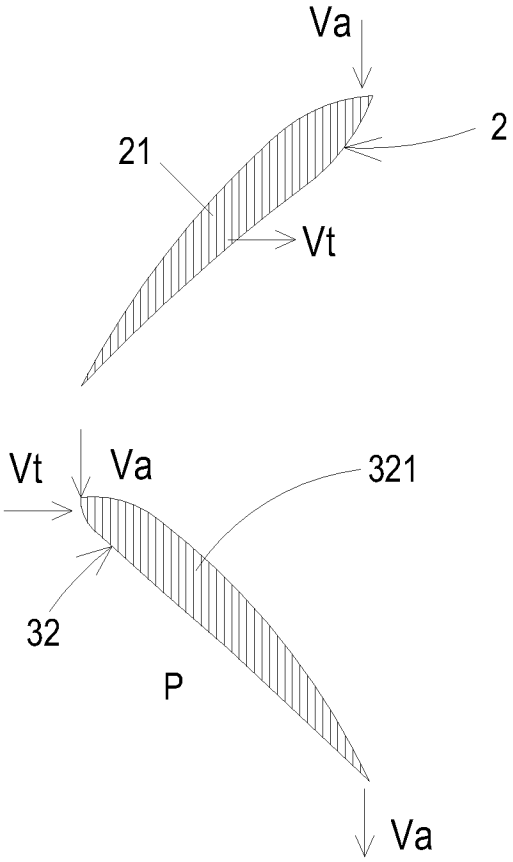
FIG. 3 schematically illustrates an example of transforming a tangent velocity into a static pressure of a receiving portion of a fan according to an embodiment of the present invention.

The mechanism of transforming the tangent velocity of the airflow generated by rotation of the central area C into the static pressure, which is implemented by the pressure-increasing blade assembly assembled with the third blades 321 of the receiving portion 32 and the first blades 21 of the impeller 2, will be described below. Please refer to FIGS. 2A, 2B and 3. FIG. 3 schematically illustrates an example of transforming a tangent velocity into a static pressure of a receiving portion of a fan according to an embodiment of the present invention. As shown in FIGS. 2A, 2B and 3, the receiving portion 32 of the fan 1 of the present invention is disposed on an airflow path of the central area C of the impeller 2, which is an airflow outlet of the first blades 21 of the impeller 2. The third blades 321 of the receiving portion 32 are matched to or coupled to the first blades 21 located in the central area C. In other words, the third blades 321 of the receiving portion 32 have the similar shape and exterior as the first blades 21 of the impeller 2. Under this circumstance, a head end of either of the first blades 21 is aligned with a tail end of either of the third blades 321 in an instant of rotation of the impeller 2, so that the tangent velocity of the airflow generated by the first blades 21 of the impeller 2 is transformed into the static pressure and the pressure generated by the central area C of the impeller 2 is increased.

For example, a velocity of the airflow generated by the central area C of the impeller 2 (i.e. the first blades 21) can be decomposed into a vertical vector and a horizontal vector, which is the axial velocity Va and the tangent velocity Vt, respectively. The axial velocity Va can be completely outputted. By design of the matched shape of the third blades 321 of the receiving portion 32 and the first blades 21, the pressure-increasing blade assembly is assembled to change the direction of the tangent velocity Vt and transform the tangent velocity Vt into the static pressure P so as to be outputted, in which the output-pressure of the central area C is increased. As a result, compared with the conventional fan which only outputs the axial velocity Va, the fan 1 of the present invention achieves the advantages of equilibrating the pressure outputted and the work done by the impeller 2 and being used for high-efficiency and large-area heat-dissipation via the pressure-increasing blade assembly.

Figure 4:
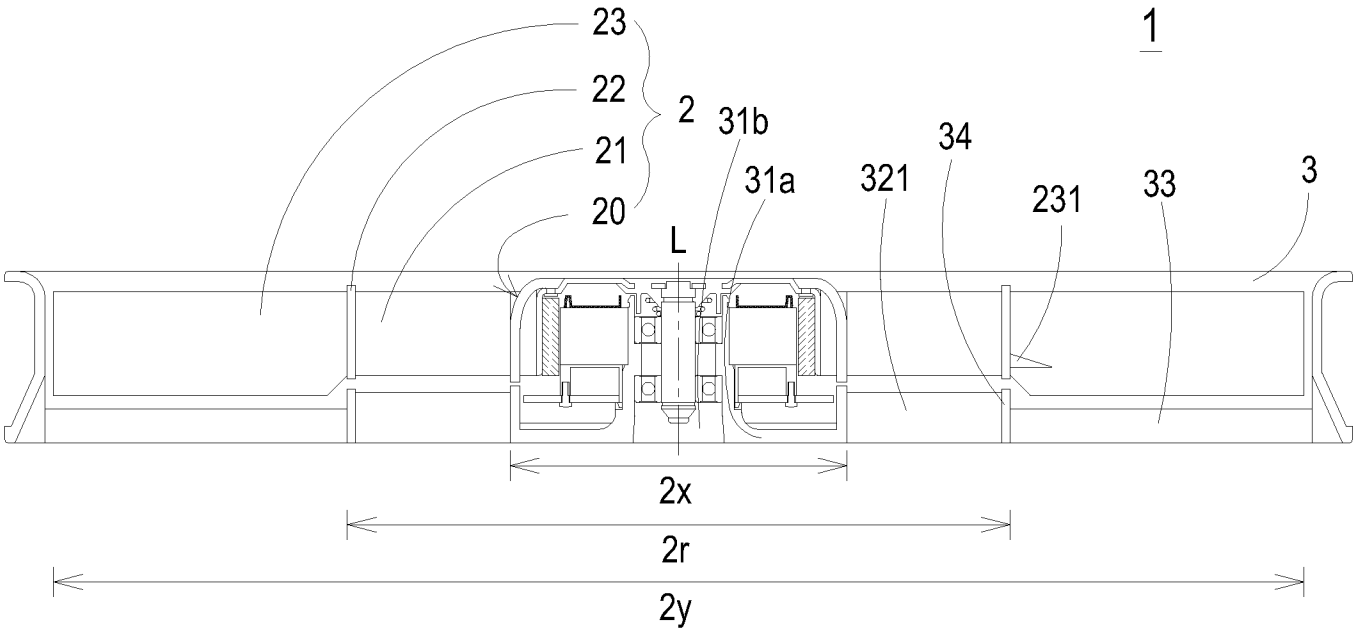
FIG. 4 schematically illustrates a cross-sectional view of the fan along line A-A in FIG. 2A.

Please refer to FIGS. 1 and 4. FIG. 4 schematically illustrates a cross-sectional view of the fan along line A-A in FIG. 2A. The impeller 2 is pivotally disposed on the axle tube portion 31*b* and axially rotates around a central axis L of the axle tube portion 31*b*. The impeller 2 may rotate clockwise around the central axis L or rotate counter-clockwise around the central axis L. The impeller 2 is forming the central area C in the specific radius r and including a hub 20, a plurality of first blades 21, a first ring-shaped structure 22 and a plurality of third blades 23. The first blades 21 are disposed around the hub 20. The first ring-shaped structure 22 is connected with ends of the first blades 21. The hub 20 and the first blades 21 are surrounded by the first ring-shaped structure 22 in the specific radius r. The second blades 23 are equidistantly connected with the outer rim of the first ring-shaped structure 22, respectively. An example of the second blades 23 may be extended from the first blades 21, but not limited thereto. Also, the first blades 21 and the second blades 23 may have different structures and exteriors. The receiving portion 32 includes a plurality of third blades 321. The third blades 321 are disposed adjacent the base 31*a* corresponding to the central area C of the impeller 2. The receiving portion 32 is coupled to the first blades 21 located in the central area C in order to transform the tangent velocity of the airflow generated by rotation of the central area C of the impeller 2 into the static pressure and increase the pressure generated and outputted by the central area C.

Please refer to FIGS. 2A, 2B and 4. The impeller 2 is forming the central area C in the specific radius r. In this embodiment, the ratio of the specific radius r to a wing tip radius y is greater than 0.5 (i.e. $r/y>1/2$) and the ratio of the specific radius r to a hub radius x of the hub 20 is less than 2 (i.e. $r/x<2/1$). The length of the wing tip radius y is equal to the distance between a wing tip of the second blades 23 of the impeller 2 and the central axis L, and the length of the hub radius x is equal to the radius of the hub 20 of the impeller 2. Preferably, the specific radius r is preferred to meet the conditions of "$r/y>1/2$" and "$r/x<2$" at the same time, which can be simplify to "$0.5y<r<2x$". In other words, the specific radius r is preferred to be greater than a half of the wing tip radius y and less than twice the hub radius x, in which the equilibrium of work and pressure is optimum.

Figure 5:
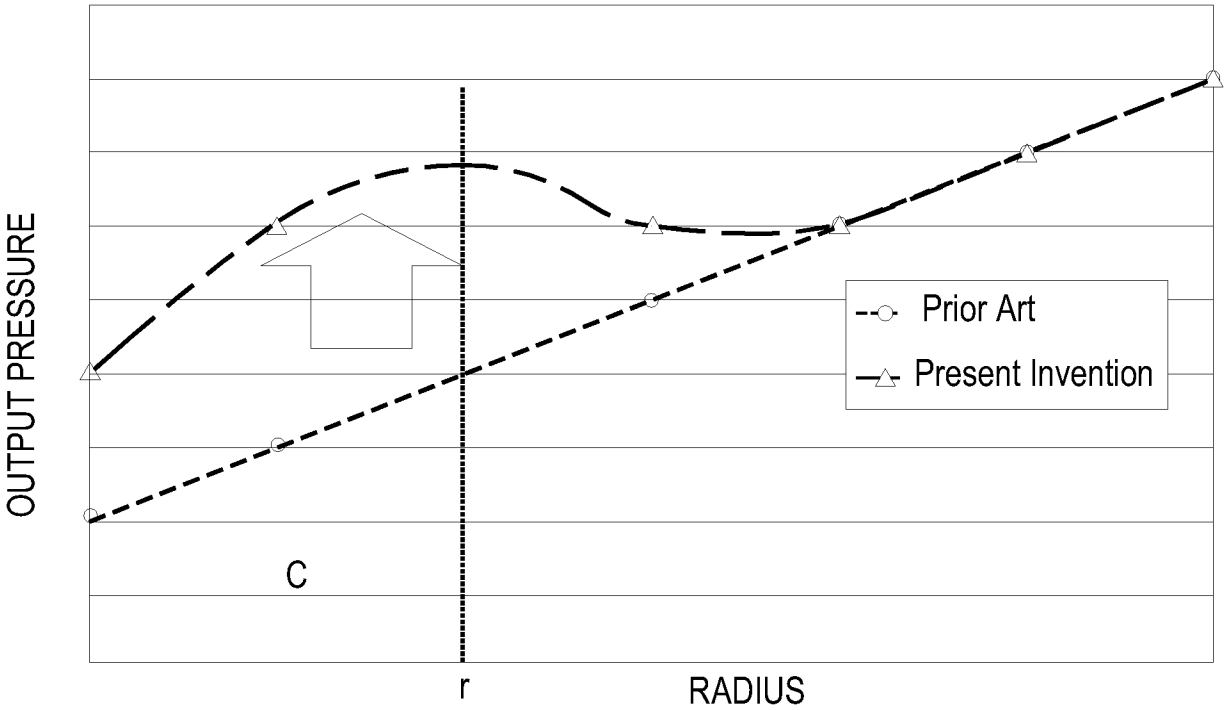
FIG. 5 schematically illustrates a corresponding graph of the radius of a fan versus the output-pressure outputted by the fan according to an embodiment of the present invention.

Please refer to FIGS. 4 and 5. FIG. 5 schematically illustrates a corresponding graph of the radius of a fan versus the output-pressure outputted by the fan according to an embodiment of the present invention. The output pressure of FIG. 5 is measured at an ideal airflow outlet of the fan 1, and the radius of FIG. 5 is a continuous radius from the central axis L. It is well known that the output pressure of the conventional fan is in direct proportion to the radius of the conventional fan of prior art. However, the fan and the pressure-increasing blade assembly thereof of the present invention increase the output pressure generated and outputted by the central area C of the impeller 2, such that the output pressure outputted by the impeller 2 is equilibrated and the work done by the fan 1 is also equilibrated. As a result, the present invention achieves the advantages of reducing the waste of driving force and being used for high-efficiency and large-area heat-dissipation.

From the above description, the present invention provides a fan and a pressure-increasing blade assembly thereof. The fan utilizes a receiving portion to transform a velocity of an airflow generated by a central area of the fan into a static pressure so as to equilibrate the output-pressure and the work done by an impeller, in which the fan is used for high-efficiency and large-area heat-dissipation. On the other hand, since the receiving portion is disposed corresponding to the central area of the impeller and the structure of the receiving portion is matched to the central area of the impeller, the waste of space and energy is avoided and the product requirement of smaller size and thinner thickness is satisfied.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan, comprising:

an impeller forming a central area in a specific radius and the impeller comprising:

a hub;

a plurality of first blades disposed around the hub;

a first ring-shaped structure connected with ends of the first blades, wherein the hub and the first blades are surrounded by the first ring-shaped structure, and the central area is structured between the first ring-shaped structure and the hub; and a plurality of second blades connected with an outer rim of the first ring-shaped structure, wherein the second blades are extending parts of the first blades; and a frame comprising:

a base;

an axle tube portion disposed on the base, wherein the impeller is disposed on the axle tube portion; and a receiving portion including a plurality of third blades, wherein the third blades are disposed around the base and corresponding to the central area of the impeller, a plurality of ribbings; and a second ring-shaped structure, wherein the second ring-shaped structure is disposed opposite the first ring-shaped structure of the impeller and connected with the ribbings, the receiving portion is disposed between the base and the second ring-shaped structure corresponding to the central area of the impeller, an end of each of the third blades is connected with the base, and the other end of each of the third blades is connected with the second ring-shaped structure, wherein the third blades, the second ring-shaped structure and the ribbings of the frame are sequentially disposed along radial directions, outwardly, the covered area of the first blades along the axial direction is overlapped with the covered area of the third blades along the axial direction, the covered area of the second blades along the axial direction is overlapped with the ribbings, the third blades of the receiving portion are disposed on an airflow path of the central area of the impeller, the first blades and the third blades are matched to each other to be assembled as a pressure increasing blade assembly, the third blades have the similar shape and exterior as the first blades, and when a head end of any of the first blades is axially aligned with a tail end of any of the third blades in an instant of rotation of the impeller, a tail end of the first blade is also axially aligned with a head end of the third blade, so that a tangent velocity of an airflow generated by the first blades is transformed into the static pressure, and the pressure generated by the central area of the impeller is increased, and the air flow is flowed from the first blades towards the third blades.

2. The fan according to claim 1, wherein the second blades are equidistantly connected with the outer rim of the first ring-shaped structure, respectively.

3. The fan according to claim 1, wherein at least one of the second blades has a strengthening rib disposed on the second blade and connected with the first ring-shaped structure for facilitating the fixing of the second blade and strengthening the connection between the second blade and the first ring-shaped structure.

4. The fan according to claim 1, wherein the impeller is pivotally disposed on the axle tube portion, and the impeller axially rotates around a central axis of the axle tube portion.

5. The fan according to claim 4, wherein the ratio of the specific radius to a wing tip radius is greater than 0.5, and the length of the wing tip radius is equal to the distance between a wing tip of the second blades of the impeller and the central axis.

6. The fan according to claim 5, wherein the ratio of the specific radius to a hub radius is less than 2, and the length of the hub radius is equal to the radius of the hub of the impeller.

7. The fan according to claim 1, wherein the first blades force air toward the same direction as the third blades.

8. The fan according to claim 1, wherein the first blades and the second blades force air toward the same direction or toward different directions.

9. A pressure-increasing blade assembly of a fan, the fan comprising:

an impeller forming a central area in a specific radius and the impeller comprising:

a hub;

a plurality of first blades disposed around the hub;

a first ring-shaped structure connected with ends of the first blades, wherein the hub and the first blades are surrounded by the first ring-shaped structure, and the central area is structured between the first ring-shaped structure and the hub; and a plurality of second blades connected with an outer rim of the first ring-shaped structure, wherein the second blades are extending parts of the first blades; and a frame comprising:

a base;

an axle tube portion disposed on the base, wherein the impeller is disposed on the axle tube portion; and a receiving portion including a plurality of third blades, wherein the third blades are disposed around the base and corresponding to the central area of the impeller, a plurality of ribbings; and a second ring-shaped structure, wherein the second ring-shaped structure is disposed opposite the first ring-shaped structure of the impeller and connected with the ribbings, the receiving portion is disposed between the base and the second ring-shaped structure corresponding to the central area of the impeller, an end of each of the third blades is connected with the base, and the other end of each of the third blades is connected with the second ring-shaped structure, wherein the third blades, the second ring-shaped structure and the ribbings of the frame are sequentially disposed along radial directions, outwardly, the covered area of the first blades along the axial direction is overlapped with the covered area of the third blades along the axial direction, the covered area of the second blades along the axial direction is overlapped with the ribbings, the third blades of the receiving portion are disposed on an airflow path of the central area of the impeller, the first blades and the third blades are matched to each other to be assembled as a pressure increasing blade assembly, the third blades have the similar shape and exterior as the first blades, and when a head end of any of the first blades is axially aligned with a tail end of any of the third blades in an instant of rotation of the impeller, a tail end of the first blade is also axially aligned with a head end of the third blade, so that a tangent velocity of an airflow generated by the first blades is transformed into the static pressure, and the pressure generated by the central area of the impeller is increased, and the air flow is flowed from the first blades towards the third blades.

10. The pressure-increasing blade assembly according to claim 9, wherein the impeller is pivotally disposed on the axle tube portion, and the impeller axially rotates around a central axis of the axle tube portion.

11. The pressure-increasing blade assembly according to claim 10, wherein the ratio of the specific radius to a wing tip radius is greater than 0.5, and the length of the wing tip radius is equal to the distance between a wing tip of the second blades of the impeller and the central axis.

12. The pressure-increasing blade assembly according to claim 11, wherein the ratio of the specific radius to a hub radius is less than 2, and the length of the hub radius is equal to the radius of the hub of the impeller.

13. A pressure-increasing blade assembly of a fan, comprising:

an impeller forming a central area in a specific radius and the impeller comprising:

a hub;

a plurality of first blades disposed around the hub;

a first ring-shaped structure connected with ends of the first blades, wherein the hub and the first blades are surrounded by the first ring-shaped structure, and the central area is structured between the first ring-shaped structure and the hub; and a plurality of second blades connected with an outer rim of the first ring-shaped structure, wherein the second blades are extending parts of the first blades, and wherein the air is forced toward the same direction or toward different directions by the first blades and the second blades; and a frame comprising:

a base;

an axle tube portion disposed on the base, wherein the impeller is disposed on the axle tube portion; and a receiving portion including a plurality of third blades, wherein the third blades are disposed around the base and an airflow path of the central area of the impeller, a plurality of ribbings; and a second ring-shaped structure, wherein the second ring-shaped structure is disposed opposite the first ring-shaped structure of the impeller and connected with the ribbings, the receiving portion is disposed between the base and the second ring-shaped structure corresponding to the central area of the impeller, an end of each of the third blades is connected with the base, and the other end of each of the third blades is connected with the second ring-shaped structure, wherein the third blades, the second ring-shaped structure and the ribbings of the frame are sequentially disposed along radial directions, outwardly, the covered area of the first blades along the axial direction is overlapped with the covered area of the third blades along the axial direction, the covered area of the second blades along the axial direction is overlapped with the ribbings, the first blades and the third blades are matched to each other to be assembled as the pressure increasing blade assembly, the third blades have the similar shape and exterior as the first blades, and the air is forced toward the same direction by the first blades and the third blades;

and when a head end of any of the first blades is axially aligned with a tail end of any of the third blades in an instant of rotation of the impeller, a tail end of the first blade is also axially aligned with a head end of the third blade, so that a tangent velocity of an airflow generated by the first blades is transformed into the static pressure, and the pressure generated by the central area of the impeller is increased, and the air flow is flowed from the first blades towards the third blades.

14. The pressure-increasing blade assembly according to claim 13, wherein the impeller is pivotally disposed on the axle tube portion, and the impeller axially rotates around a central axis of the axle tube portion.

15. The pressure-increasing blade assembly according to claim 14, wherein the ratio of the specific radius to a wing tip radius is greater than 0.5, and the length of the wing tip radius is equal to the distance between a wing tip of the second blades of the impeller and the central axis.

16. The pressure-increasing blade assembly according to claim 15, wherein the ratio of the specific radius to a hub radius is less than 2, and the length of the hub radius is equal to the radius of the hub of the impeller.

* * * * *